United States Patent [19]

Lore et al.

[11] 4,192,078

[45] Mar. 11, 1980

[54] AUTOMATICALLY RETRACTABLE CHALK AND PLUMB LINE ASSEMBLY

[76] Inventors: Nicola Lore, 35 Burkhardt Ave., Bethpage, N.Y. 11714; Corrado Lore, 65 Benedict Ave., Valley Stream, N.Y. 11580

[21] Appl. No.: 34,123

[22] Filed: Apr. 27, 1979

Related U.S. Application Data

[63] Continuation of Ser. No. 865,717, Dec. 29, 1977, abandoned.

[51] Int. Cl.[2] ..... B44D 3/38

[52] U.S. Cl. ..... 33/414

[58] Field of Search ..... 33/413, 414; 220/327, 220/345, 346; 242/96,99, 107.6

[56] References Cited

U.S. PATENT DOCUMENTS

| | | | |
|---|---|---|---|
| 378,022 | 2/1888 | Snedigar | 220/345 |
| 627,057 | 6/1899 | Gavin | 33/414 |
| 990,161 | 4/1911 | Paiste | 220/345 X |
| 1,168,851 | 1/1916 | Carter | 33/414 |
| 1,272,270 | 7/1918 | Jarrio | 33/414 |
| 1,567,976 | 12/1925 | Myers | 33/414 |
| 2,749,618 | 6/1956 | Landon | 33/414 |
| 3,888,010 | 6/1975 | Hyde et al. | 33/414 |

FOREIGN PATENT DOCUMENTS

| | | | |
|---|---|---|---|
| 790558 | 11/1935 | France | 33/414 |
| 1059399 | 2/1967 | United Kingdom | 242/96 |

*Primary Examiner*—Charles E. Phillips

*Attorney, Agent, or Firm*—Herbert L. Lerner

[57] ABSTRACT

Automatically retractable chalk and plumb line assembly including a housing having two compartments, one of the compartments being formed with a closable first opening through which chalk is receivable in the one compartment, the other of the compartments being sealed against penetration by chalk from the one compartment, a reel disposed in the one compartment, a line wound on said reel and unwindable so as to extend out of the housing through a second opening formed in the one compartment and means disposed in the other compartment for rewinding the line on the reel.

1 Claim, 4 Drawing Figures

FIG. 1
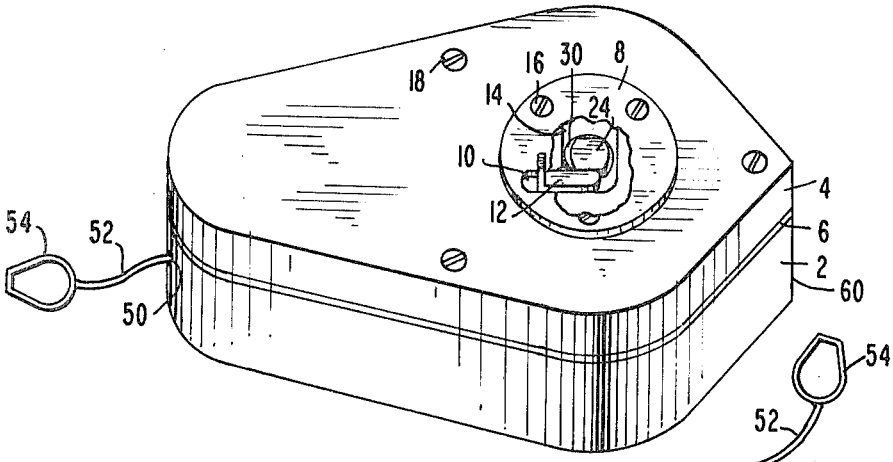
FIG. 2
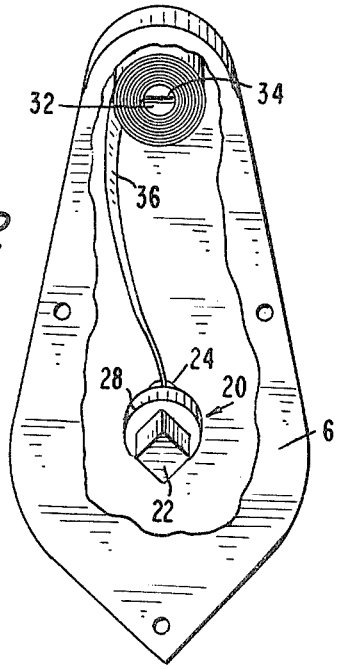
FIG. 3
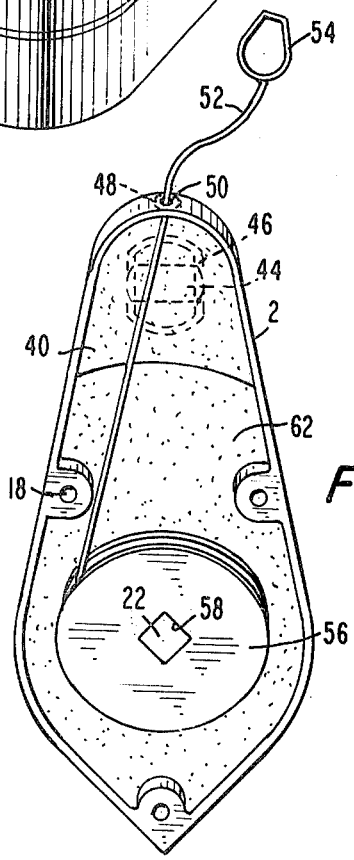
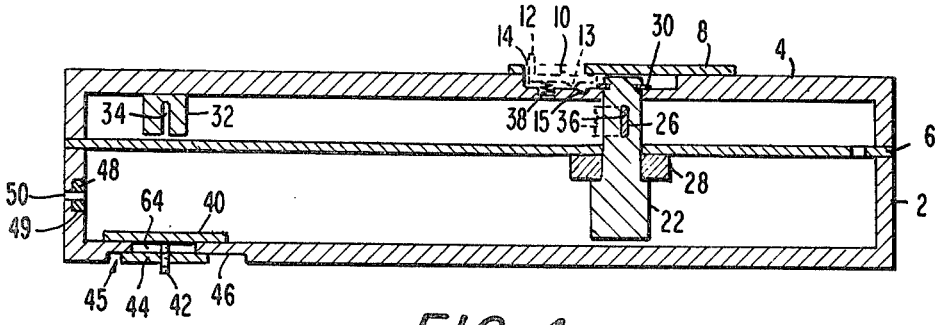
FIG. 4

AUTOMATICALLY RETRACTABLE CHALK AND PLUMB LINE ASSEMBLY

This is a continuation of application Ser. No. 865,717, filed Dec. 29, 1977, now abandoned.

The invention relates to a chalk and plumb line assembly of the general type where powdered chalk is stored within the housing where the chalk line is wound. Although tools having automatically retractable components are known, a particular problem arises with chalk lines. If a spring or other suitable rewinding device were to be used to retract the line, the powdered chalk would coat the spring and eventually clog the mechanism to the point where it would not rectract automatically and eventually it would not extend fully. Chalk and plumb lines are presently made with cranking retraction devices which prove to be time consuming and therefore costly and wasteful to operate, especially since a workman may have to fully extend the line many times a day.

It is therefore an object of the invention to overcome the above-mentioned shortcomings of the heretofore known devices of the general type and to provide an automatically retractable chalk and plumb line assembly wherein the chalk is prevented from reaching the rewinding mechanism.

With the foregoing and other objects in view, there is provided in accordance with the invention an automatically retractable chalk and plumb line assembly including a housing having two compartments, one of the compartments being formed with a closable first opening through which chalk is receivable in the one compartment, the other of the compartments being sealed against penetration by chalk from the one compartment, a reel disposed in the one compartment, a line wound on said reel and unwindable so as to extend out of the housing through a second opening formed in the one compartment and means disposed in the other compartment for rewinding the line on the reel.

The rewinding device may take the form of a number of conventional mechanical or electrical force storage devices. In accordance with another feature of the invention, it is provided that the rewinding means is a helical spring.

In accordance with a further feature of the invention, there is provided a wall disposed between the compartments, and a rotatable shaft disposed in the other compartment and extending therefrom into the one compartment, the helical spring being secured at one end thereof to the rotatable shaft in the other compartment and at the other end thereof to another location within the other compartment, the reel being mounted on the shaft in the one compartment.

In order to allow the line to remain in a partially or fully extended condition, against the force of the spring, a positive locking device is necessary to stop rotation of the shaft or slow it to permit rewinding at a reduced speed. Therefore, in accordance with an additional feature of the invention, it is provided that the other compartment is formed with an opening through which an end of the rotatable shaft extends, and including means engageable with the end of the rotatable shaft for inhibiting rotation thereof.

In accordance with a concomitant feature of the invention, there are provided means disposed at the second opening formed in the one compartment and brushingly engaging with said line for removing excess chalk therefrom.

In accordance with an added feature of the invention, the inhibiting means is an L-shaped tongue having a rounded end, the tongue being slidable in a groove formed in the housing and located adjacent the opening formed in the other compartment, and including means for locking the tongue against the end of the rotatable shaft.

In accordance with another feature of the invention, there is provided a plate disposed within the one compartment and having a threaded member extending therefrom out of the closable opening, a nut threadedly mounted on the threaded member and adjustable for closing the closable opening.

In accordance with a further feature of the invention, the nut is disposed in a recess formed in the housing.

Other features which are considered as characteristic for the invention are set forth in the appended claims.

Although the invention is illustrated and described herein as embodied in an automatically retractable chalk and plumb line assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic side perspective view of the automatically retractable chalk and plumb line of the invention in closed position, partly broken away;

FIG. 2 is a diagrammatic top perspective view, partly broken away, of the sealed compartment of the invention, which is the upper part in FIG. 1;

FIG. 3 is a diagrammatic top plan view of the lower part of the housing of the invention according to FIG. 1; and FIG. 4 is a diagrammatic cross-sectional view of FIG. 1 with the reel and spring removed.

Referring now to the figures of the drawings and first, particularly, to FIG. 1 thereof, there is seen a combination chalk and plumb line in a housing which may be constructed of any rigid material such as cast aluminum. The housing is made up of two compartments which may be described as a one lower compartment 2 and another upper compartment 4 as viewed in FIG. 1. A line 52 may be pulled out of the housing through the hole 50 and used to chalk a line on a floor or a wall as a chalk line or may be hung from the end of the line 52 and allowed to come to rest to be used as a plumb line. For this reason the line 52 emerges from the housing in the geometric and mass center of the housing. The sharp edge 60 is used to mark the lower end of the plumb at the end of the vertical line and is therefore also in the center of the housing.

The line 52 is wound around a reel 56 in the one lower housing compartment 2 as shown in FIG. 3. The cutout 58 of the reel 56 is disposed on the upper end 22 of a shaft 20 (FIG. 2). The line passes through a space 62, which is filled with powdered chalk, before exiting through the hole 50. In this way the string picks up chalk before leaving the housing. Adjacent the hole 50 is a wiping member in the form of a piece of cloth or felt or other suitable material 48 in a cutout 49 in the wall of the lower housing part 2 which serves to remove excess chalk from the line before it is pulled out. The end of the line 52 is attached to a ring 54 which is placed on a nail or hook to hold the line 52 taut. Chalk is filled into the space 62 by moving the plate 40 towards the reel 56 and exposing an opening therebeneath. In FIG. 4 it is seen that one end of a threaded post 42 is attached to the plate 40. On the other end of the post 42 is screwed a rectangular nut 44 in an oval cutout 45 in the housing part 2. The plate 40 and the nut 44 sandwich in the narrowed portion 46 of the lower one housing compartment 2. In order to fill in chalk the nut 44 is loosened and the nut 44 and plate 40 are pushed towards the right in FIG. 4 to expose part of an opening 64 for filling in chalk. A conventional stopper or screw cap arrangement may also be used to seal the opening 64.

Between the upper other compartment 4 and the lower one compartment 2 of the housing is a wall 6 as seen in FIG. 1. The wall 6 is held firmly in place by screws which are fastened through three holes 18. Either housing part may be threaded for this purpose and the screw heads recessed in the opposite housing part. In FIG. 2 the upper other housing compartment 4 is shown alone and turned upside-down from the view of FIG. 1. The wall 6 has been broken away so the internal parts are visible. The shaft 20 is seen to have two parts. The upper part 22 has a square cross section and fits into the reel 56 as seen in FIG. 3. The lower part 24 is cylindrical and passes through a cutout as seen in FIG. 1. The shaft part 24 has a slot 26. A washer 38 is located at the lower end of the square portion 22 of the shaft 20 above the wall 6 as seen in FIG. 2. The screws 18 and the washer 28 effectively keep all chalk out of the compartment 4. At the lower end of FIG. 2 is another shaft or pin 32 which has a split 34. One end of a helical spring 36 is secured to the shaft 32 through the split 34 and is tightly wound around the shaft 32 as shown, to be pretentioned. The other end of the spring 36 is secured to the cylindrical part 24 of the shaft 20 through the split 26. The placement of the shafts 32, 20 help balance the weight to provide a true vertical plumb. When the line 52 is pulled out through the hole 50 in the housing, the reel 56 turns clockwise as viewed in FIG. 3. The reel turns the shaft 20 which winds the spring 36 off the shaft 32 and onto the shaft part 24. When the line 52 is released, the spring 36 tends to turn the shaft 20 counter clockwise as viewed in FIG. 3 and rewinds the line 52 on the reel 56.

The wall 6 together with the upper other housing compartment 4 forms a sealed compartment and prevents chalk from the lower one compartment from entering the upper housing compartment 4 where it would coat the spring 36 and eventually limit the force storage capabilities thereof.

When the line 52 has been pulled out the desired amount it may be locked through the mechanism shown at the end of the shaft part 24 in FIGS. 1 and 4. A plate 8 is shown fastened to the housing part 4 by screws 16. Under the broken-away circular plate 8 in FIG. 1 is shown a cutout 14 in the upper housing part 4. This cutout is also seen in dotted lines in FIG. 4. The end of the shaft part 24 is square and protrudes through the upper housing part 4 into the cutout 14. A retaining washer 30 is disposed near the square end of the shaft part 24 in a groove and serves to keep the shaft 20 in place. The circular plate 8 has a cutout 10 along a tangent to the shaft part 24. Under the plate 8 in the cutout 14 is a tongue 12 with a rounded end. The other end of the tongue 12 is bent-up and protrudes through the cutout 10 in the plate 12. A spring 38 (FIG. 4) keeps the tongue riding above the height of the retaining washer 30. When the line 52 is to be held in place partly removed from the housing, the bent-up end of the tongue 12 is pushed to the right, as seen in the drawings, so that the side of the tongue 12 contacts the square end of the shaft part 24. If the line 52 is to be retracted slowly, the tongue 12 can be slid into a position where the rounded end merely drags against the square end of the shaft 24. The cutout 14 also has a depression 15 further cut therein below the tongue 12 to the right of the spring 38 in FIG. 4. The tongue 12 has a dimple 13 on the bottom thereof which catches in the depression 15 when the tongue 12 is in the locked position against the shaft part 24. The spring 38 produces a lever action which pushes the dimple 13 into the depression 15.

There are claimed:

1. Automatically retractable chalk and plumb line assembly, comprising a housing in the form of a plumb bob having tapered lower and upper ends and being divided into two compartments, said housing being formed with a first and a second opening into one of said compartments, said second opening being located in an upper end of said one compartment, a reel disposed in said one compartment with a plumb line wound thereon and being unwindable so as to extend out of said housing through said second opening, said one compartment being fillable through said first opening with powdered chalk freely engageable with said reel and plumb line disposed within said one compartment, the other of said compartments being sealed against penetration by chalk from said one compartment and having a helical spring disposed therein for rewinding said plumb line on said reel, and including a wall disposed between said compartments, and a rotatable shaft disposed in said other compartment and extending therefrom into said one compartment, said helical spring being secured at one end thereof to said rotatable shaft in said other compartment and at the other end thereof to another location within said other compartment, said reel being mounted on said shaft in said one compartment, said other compartment being formed with an opening through which an end of said rotatable shaft extends, and including an L-shaped tongue having a rounded end and being engageable with said end of said rotatable shaft for inhibiting rotation thereof, said tongue being slidable in a groove formed in said housing and located adjacent said opening formed in said other compartment, and including means for locking said tongue against said end of said rotatable shaft, said end of said shaft being formed with at least one flat portion at the periphery thereof and including means for locking said tongue, in a fully extended position thereof, against one of said flat portions of said shaft, said tongue, in another position being disposed so that said rounded end thereof is alternately engageable with said flat portions and rounded peripheral portions of said shaft for gradually slowing down rotation of said shaft.

2. Assembly according to claim 1 including a plate disposed within said one compartment and having a threaded member extending therefrom out of said first opening, and a nut threadedly mounted on said threaded member and adjustable for slidably closing said closable opening.

3. Assembly according to claim 2 wherein said nut is disposed in a recess cut into the surface of said housing.

* * * * *